US006056311A

United States Patent [19]

Leung

[11] Patent Number: 6,056,311

[45] Date of Patent: May 2, 2000

[54] SKIING AND SURFING APPARATUS PRODUCING INCREASED LIFT

[75] Inventor: Kam Fong Leung, Little Elm, Tex.

[73] Assignee: Dal Research Enterprises, Inc., Little Elm, Tex.

[21] Appl. No.: 09/133,285

[22] Filed: Aug. 12, 1998

[51] Int. Cl.[7] ..... B62B 9/04; A63C 5/04; B63B 1/00

[52] U.S. Cl. ..... 280/609; 441/68; 280/14.2

[58] Field of Search ..... 441/68; 280/601, 280/602, 603, 604, 608, 609, 14.2, 18

[56] References Cited

U.S. PATENT DOCUMENTS

| | | | |
|---|---|---|---|
| 2,751,612 | 6/1956 | Shepard | 9/21 |
| 2,914,335 | 11/1959 | Rivard | 280/11.13 |
| 3,761,980 | 10/1973 | Silverstein | 9/310 |
| 4,296,511 | 10/1981 | Wright | 9/310 |
| 4,838,571 | 6/1989 | Sevington | 280/608 |
| 4,919,447 | 4/1990 | Jackson et al. | 280/609 |
| 5,427,401 | 6/1995 | Liard | 280/609 |
| 5,573,264 | 11/1996 | Deville et al. | 280/14.2 |
| 5,816,589 | 10/1998 | Southworth | 280/14.2 |
| 5,868,405 | 2/1999 | Lavecchia et al. | 280/14.2 |

*Primary Examiner*—Lanna Mai
*Assistant Examiner*—Jeffrey J. Restifo
*Attorney, Agent, or Firm*—Smith & Danamraj, P.C.

[57] ABSTRACT

An elongate board which produces increased lift when moved through a fluid such as air or water. The elongate board includes a main body with an opening in its central region. A plurality of transverse wing sections are mounted in tandem in the central opening along the longitudinal axis of the main body. Between each wing section is an open slot allowing the fluid to flow over the wing sections, creating a lifting force on the elongate board. The elongate board may be utilized in many different sports requiring the use of a ski or board, such as water skiing, snow skiing, surfboarding, snow boarding, and sky surfboarding.

24 Claims, 19 Drawing Sheets

SKIING AND SURFING APPARATUS PRODUCING INCREASED LIFT

BACKGROUND OF THE INVENTION

1. Technical Field of the Invention

This invention relates to skis and other recreational equipment, and more particularly, to an elongate skiing and surfing apparatus having a plurality of wing sections which produce increased lift.

2. Description of Related Art

Elongate boards, such as skis and snow boards are both abundant and varied in design. Elongate boards are used for a variety of sports, such as water skiing, knee boarding, wave boarding, surfboarding, snow skiing, snow boarding, and sky surfboarding. The ski enthusiast is constantly searching for improved equipment to increase their performance on their skis or boards. In many instances, the skier becomes airborne while performing various maneuvers. For example, in snow skiing, ski jumping involves using a ski ramp to propel a skier through the air. One of the primary objects of snow ski jumping is to travel the greatest distance. Therefore, increased lifting performance of the ski is desired. In water skiing, a similar event is also performed by using a ramp from which a skier is propelled above the water for a certain distance. In sky surfboarding, the longer a person can stay airborne, the more time is available for performing maneuvers in the air. Therefore, improved lifting performance for skis and boards is very important.

Although there are no known prior art teachings of a solution to the aforementioned deficiency and shortcoming such as that disclosed herein, prior art references that discuss subject matter that bears some relation to matters discussed herein are U.S. Pat. No. 3,761,980 to Silverstein (Silverstein), U.S. Pat. No. 4,296,511 to Wright (Wright), and U.S. Pat. No. 4,838,571 to Sevington (Sevington).

Silverstein discloses a water ski having a conventional ski body. The ski body has a pair of parallel depending rails on the lower ski surface defining a central longitudinal channel between the rails. The rail portions of the ski body are provided with a plurality of short inclined planes having a progressively greater angle of inclination toward the rear end of the ski. However, Silverstein does not teach or suggest utilizing a plurality of wing sections having slots to increase the lifting characteristics of the ski.

Wright discloses a water ski having front, middle, and rear sections. The rear section includes a rear tail to promote enhanced stability and maneuverability of the ski. The rear tail and the bottom surface of the rear section form an enclosed chamber having an inlet and an outlet. Additionally, the water ski includes an air channel formed by a centrally disposed depressed region of the ski body running the length of the central section. The air channel provides means for injecting air into the chamber whereby a bubble pattern is produced under the rear section of the ski. This bubble pattern creates a small ball-bearing like surface which reduces surface tension between the ski and the water. Although Wright discloses a chamber having an inlet and an outlet on the main ski body frame, Wright does not teach or suggest the formation of a tandemly arranged plurality of wing airfoils to improve the lifting qualities of the ski body.

Sevington discloses a ski having an inverted channel member with a flat base and two side walls. The inside face of the flat base lies on an upper surface of the tail of the ski. Each side wall includes a plurality of downwardly extending projections. When the ski is placed on a flat horizontal surface, such as water, the lowermost extremity of each projection is separated only by an air gap. Sevington does not teach or suggest a plurality of wing sections to improving the lifting forces of the ski body. Sevington merely discloses an inverted channel member forming projections on an underside of the separate ski members.

Review of each of the foregoing references reveals no disclosure or suggestion of an apparatus such as that described and claimed herein. Thus, it would be a distinct advantage to have an apparatus for producing increased lift on an elongate board. It is an object of the present invention to provide such an apparatus.

SUMMARY OF THE INVENTION

In one aspect, the present invention is an elongate board such as a ski which produces increased lift when moved through a fluid such as air or water. The ski includes a main body frame and a plurality of enclosed transverse wing sections mounted in tandem along the longitudinal axis of the main body frame. The wing sections are supported by the main body frame. Each wing section of the plurality of wing sections form an open slot with an adjacent wing section through which the fluid may flow.

In the preferred embodiment of the present invention, the ski includes a platform for securing the feet of a skier to the ski. The platform is raised above the frame to allow air to flow around the wing sections located directly below the platform. The ski may be used in various sports such as snow skiing, water skiing, wave boarding, surfboarding, knee boarding, snow boarding, and sky surfboarding.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF EMBODIMENTS

An apparatus for producing increased lift is disclosed. The apparatus is an elongate board which may be used in a variety of sports, such as water skiing, wave boarding, knee boarding, surfboarding, snow skiing, snow boarding, and sky surfboarding.

Figure 1:
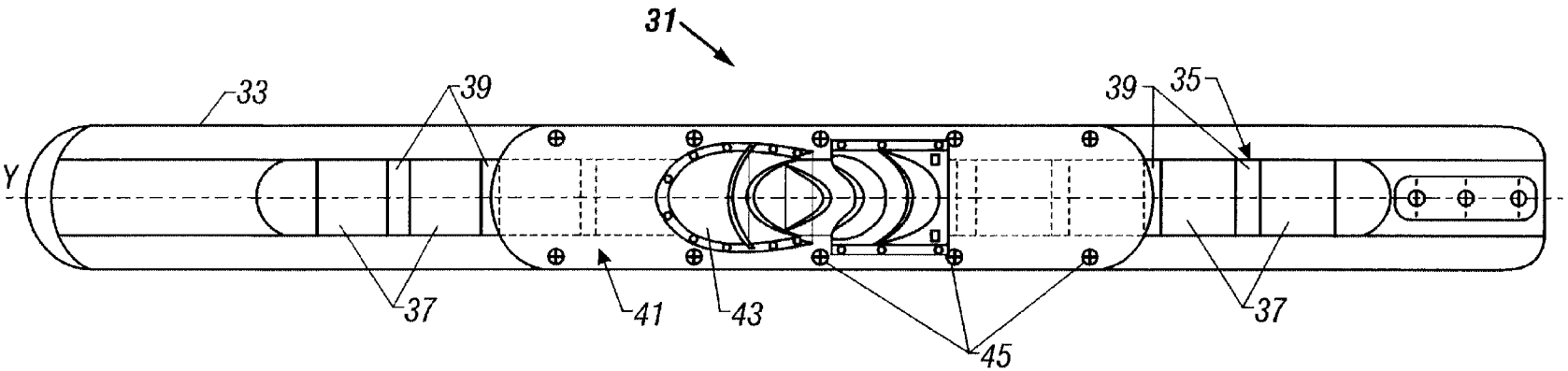
FIG. 1 is a top view of a jumping water ski manufactured according to the teachings of the present invention.

FIG. 1 is a top view of a jumping water ski 31 manufactured according to the teachings of the present invention. The jumping water ski 31 includes a main body 33 having an opening 35 in a central region of the main body 33 and a plurality of enclosed, transverse wing sections 37 mounted to the frame in the central opening 35 along a longitudinal axis Y of the main body 33. Each wing section 37 forms an open slot 39 with an adjacent wing section 37. The jumping water ski 31 also includes a foot binding board 41 supporting a foot binding 43. The foot binding board 41 is attached to the main body 33 by a plurality of mounting screws 45. The jumping water ski may be the same size, shape, and material as those water skis normally used in water skiing. For example, the jumping water ski 31 may be constructed of carbon fiber with a composite honeycomb core, although other rigid materials suitable for skis may be utilized, such as steel, aluminum, wood, plastic, etc.

Figure 2:
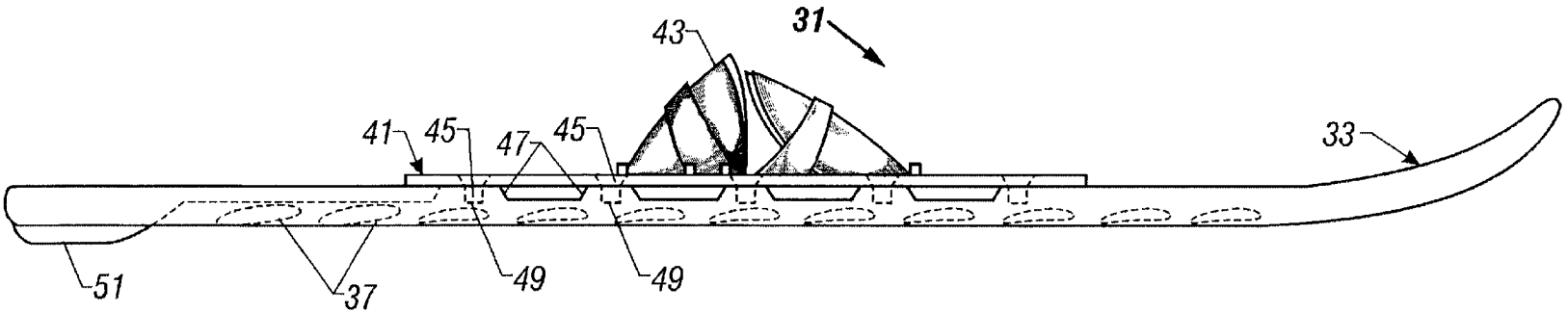
FIG. 2 is a side view of the jumping water ski of FIG. 1 with the enclosed wing sections shown in phantom.

FIG. 2 is a side view of the jumping water ski 31 of FIG. 1 with the enclosed wing sections 37 shown in phantom. The main body includes a plurality of mounts 47, which are raised platformns located along the length of the foot binding board 41. Within the mount 47 is a plurality of threaded metal inserts 49. The mounting screws 45 are inserted through the foot binding board 41 into the metal inserts 49 located in the mount 47. The jumping water ski 31 may also include a fin 51 used for improved maneuvering control by a water skier over the water. Ski jumping involves the use of a ramp to launch a water skier airborne over the water.

Figure 3:
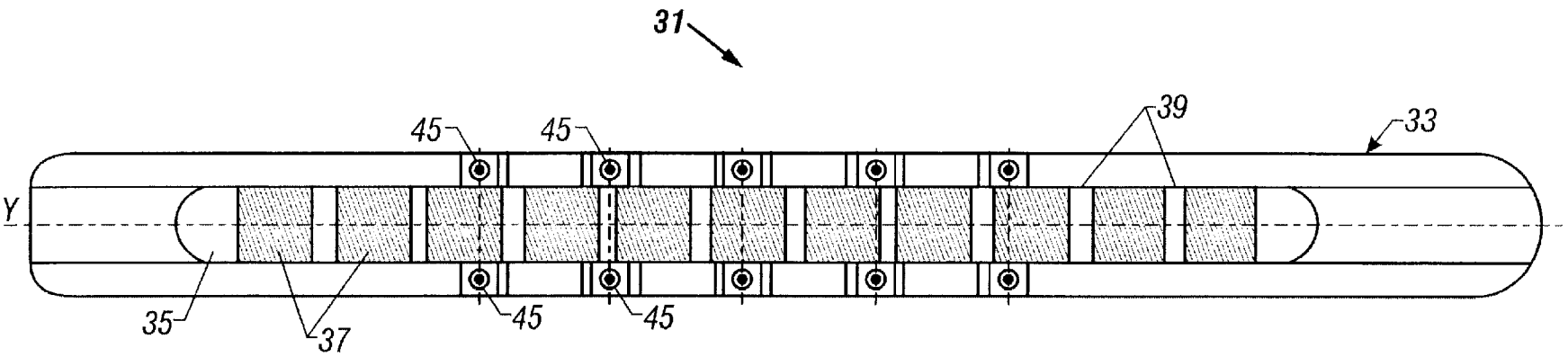
FIG. 3 is a top view of the jumping water ski without the foot binding board according to the teachings of the present invention.
Figure 4:
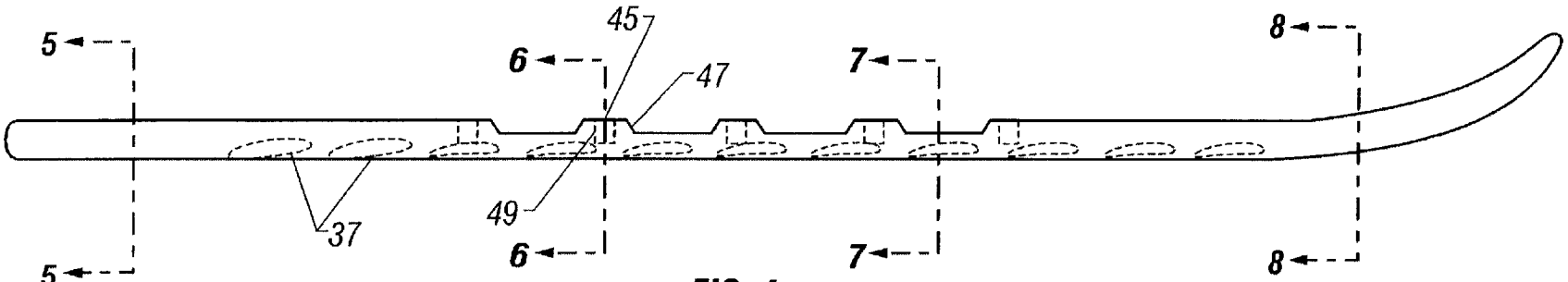
FIG. 4 is a side view of the jumping water ski of FIG. 3 with the enclosed wing sections shown in phantom.
Figure 5:
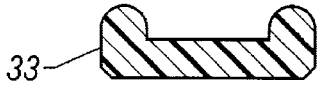
FIG. 5 is a partial cross-sectional view of the jumping water ski of FIG. 4 taken along line 5—5.
Figure 6:
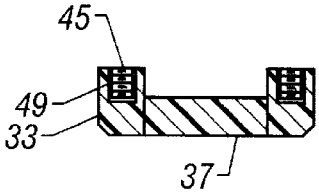
FIG. 6 is a partial cross-sectional view of the jumping water ski of FIG. 4 taken along line 6—6.
Figure 7:
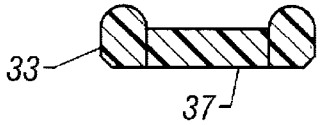
FIG. 7 is a partial cross-sectional view of the jumping water ski of FIG. 4 taken along line 7—7.
Figure 8:
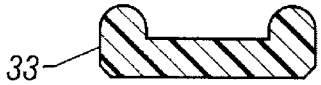
FIG. 8 is a partial cross-sectional view of the jumping water ski of FIG. 4 taken along line 8—8.

FIG. 3 is a top view of the jumping water ski 31 without the foot binding board 41 according to the teachings of the present invention. FIG. 4 is a side view of the jumping water ski 31 of FIG. 3 with the enclosed wing sections 37 shown in phantom. FIG. 5 is a partial cross-sectional view of the jumping water ski 31 of FIG. 4 taken along line 5—5. FIG. 6 is a partial cross-sectional view of the jumping water ski 31 of FIG. 4 taken along line 6—6. FIG. 7 is a partial cross-sectional view of the jumping water ski 31 of FIG. 4 taken along line 7—7. FIG. 8 is a partial cross-sectional view of the jumping water ski 31 of FIG. 4 taken along line 8—8.

Figure 9:
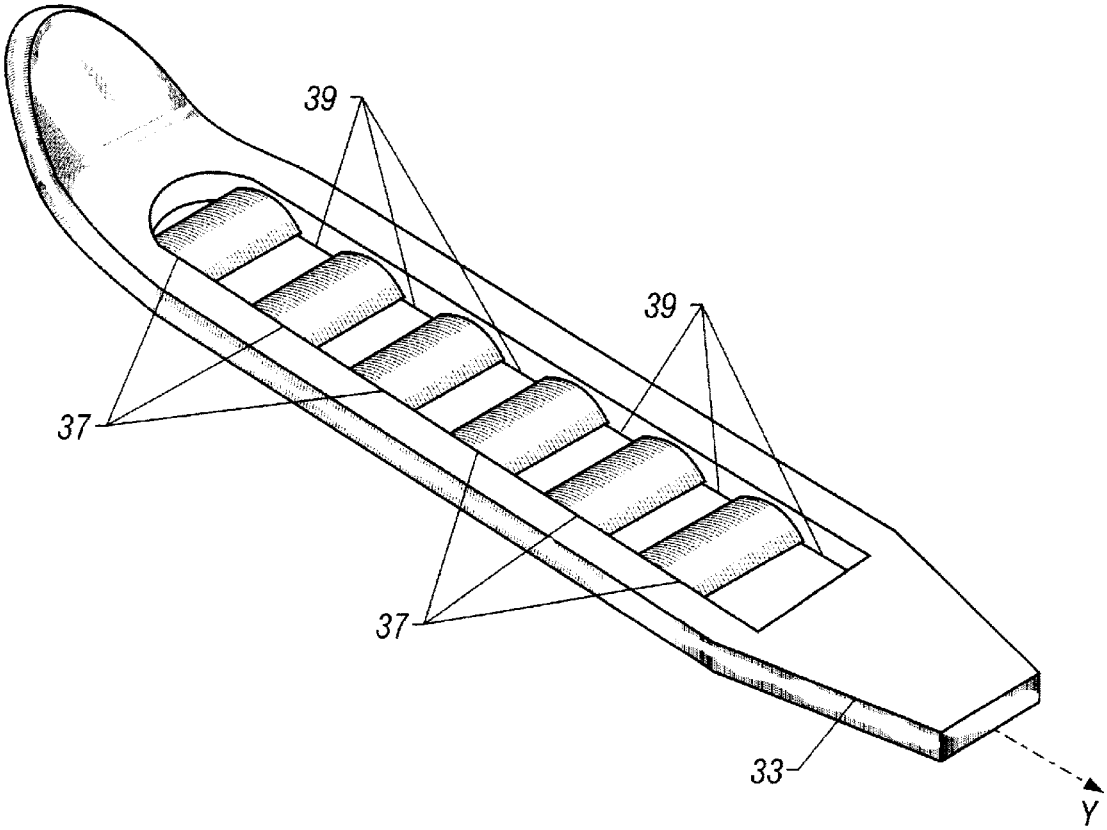
FIG. 9 is a perspective view of the jumping water ski of FIG. 1 without the foot binding board, which has been simplified by reducing the number of enclosed wing sections.

FIG. 9 is a perspective view of the jumping water ski 31 of FIG. 1 without the foot binding board 41, which has been simplified by reducing the number of enclosed wing sections 37. Each wing section 37 is supported at each side by the main body 33. The wing sections 37 are arranged in tandem along the longitudinal axis Y of the main body 33. In various embodiments, the wing sections may run the entire length of the jumping water ski 31 or may cover only a portion of the length of the jumping water ski 31. The plurality of open slots 39 are located between each wing section 37 providing a series of open spaces along most of the length of the jumping water ski 31. The open slots 39 may be any size which allows a fluid (for example, air or water) to pass over and under the wing sections 37.

Referring to FIGS. 1–9, the operation of the jumping water ski 31 will now be explained. A skier utilizes the ski in a typical manner seen in water skiing. The water skier is normally dragged by some type of boat, pulling the skier and his ski over the surface of the water. During this time, water flows over the wing sections 37 and between the open slots 39. In the preferred embodiment, the bottom portion of the wing sections 37 is horizontally flat in relation to a bottom portion of the main body 33, allowing a smoother ride over the water. Typically, a skier performs jumping maneuvers through the use of a ramp. The skier is dragged up a ramp, which causes the skier and his ski to become airborne. In most instances, the skier desires to remain airborne for as long as possible.

During this airborne portion of the skier's maneuver, the fluid flow (in this case, air) travels across the wing section 37 and acts in the same manner as an airflow traveling over a wing of an aircraft. The air accelerates over an upper portion of the wing section 37, reducing the air pressure associated with the upper portion of the wing section 37. The air flow over the lower portion of the wing section 37 is slower, and therefore has a higher pressure. A resulting lifting force from the air flow over an airfoil is well known in the field of wing design. The camber and angle of attack of the wing sections 37 determine the lifting characteristics of the jumping water ski 31. A ski manufacturer may construct the wing section 37 to optimize the lifting characteristics for the desired lifting qualities necessary for the jumping water ski 31. Therefore, by using the jumping water ski 31, a skier gains a lifting force which increase both the time and distance that the skier is airborne.

Figure 10:
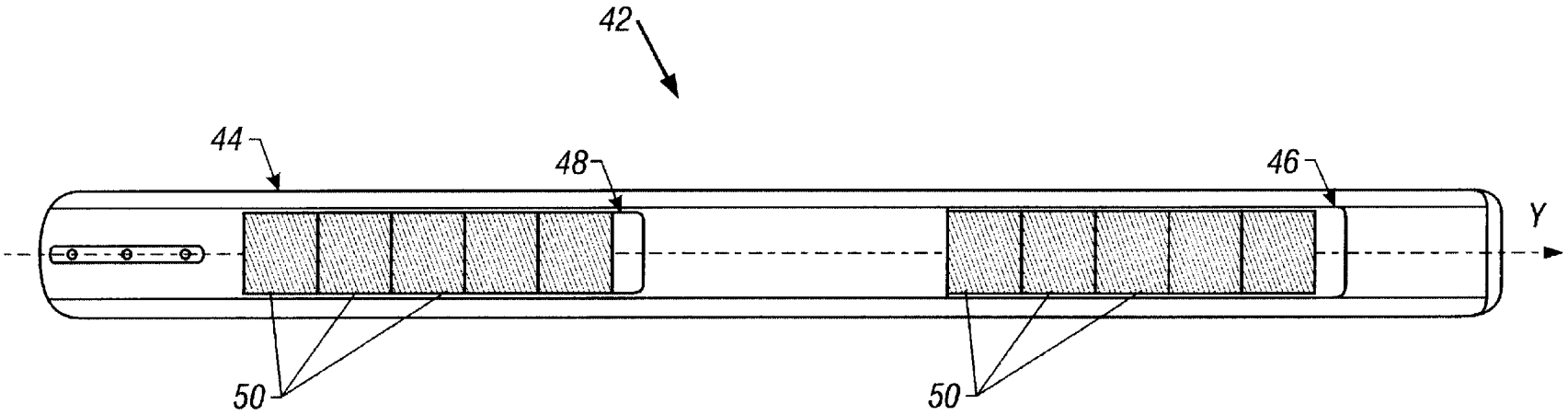
FIG. 10 is a top view of a jumping water ski without a foot binding board in an alternate embodiment manufactured according to the teachings of the present invention.

FIG. 10 is a top view of a jumping water ski 42 without a foot binding board in an alternate embodiment manufactured according to the teachings of the present invention. The jumping water ski 42 includes a main body 44 having an opening 46 and an opening 48 in a central region of the main body 44 and a plurality of enclosed, transverse wing sections 50 mounted to the frame in the openings 46 and 48 along a longitudinal axis Y of the main body 44. Each wing section 50 forms an open slot 56 (see FIG. 11) with an adjacent wing section 50. However, unlike the jumping water ski 31, the jumping water ski 42 positions the wing sections 40 to overlap one another. The jumping water ski 42 may also be the same size, shape, and material as those water skis normally used in water skiing.

In operation, the jumping water ski 42 is similar to the jumping water ski 31. Mounting the foot binding directly to the main body 44 and the overlapping of the wing sections 50 reduce the upward splashing of water toward the water skier.

Figure 11:
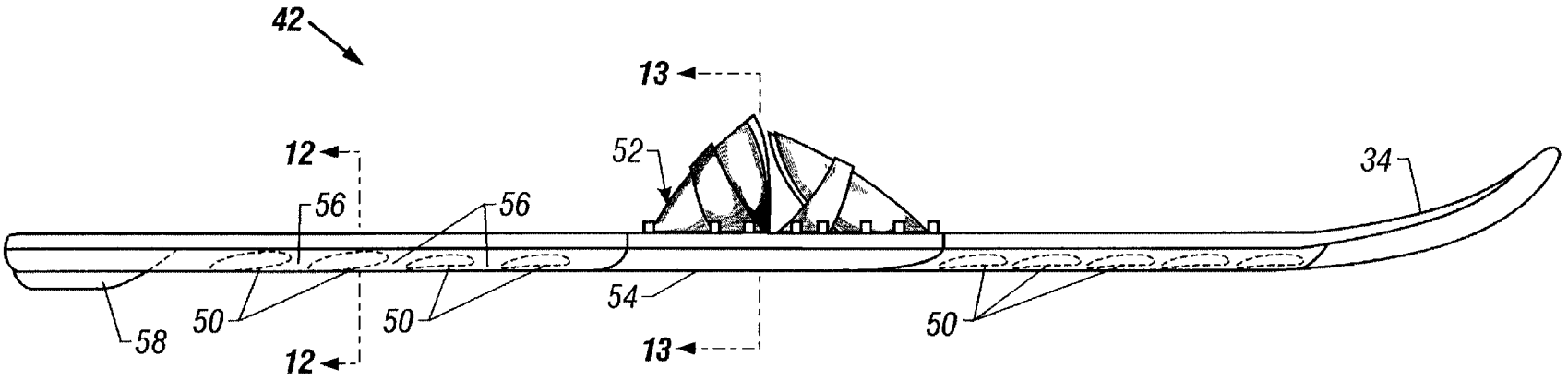
FIG. 11 is a side view of the jumping water ski of FIG. 10 with a foot binding and the enclosed wing sections shown in phantom.
Figure 12:
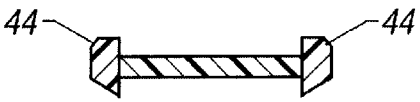
FIG. 12 is a partial cross-sectional view of the jumping water ski of FIG. 11 taken along line 12—12.
Figure 13:
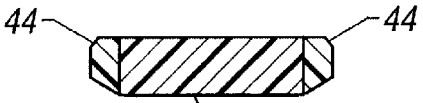
FIG. 13 is a partial cross-sectional view of the jumping water ski of FIG. 11 taken along line 13—13.

FIG. 11 is a side view of the jumping water ski 42 of FIG. 10 with a foot binding 52 and the enclosed wing sections 50 shown in phantom. The foot binding 52 is mounted directly to a center foot binding support 54 located between the openings 46 and 48. The jumping water ski 32 may also include a fin 58 used for improved maneuvering control by a water skier over the water. Between each wing section 50 is an open slot 56. FIG. 12 is a partial cross-sectional view of the jumping water ski 42 of FIG. 11 taken along line 12—12. FIG. 13 is a partial cross-sectional view of the jumping water ski 42 of FIG. 11 taken along line 13—13.

Figure 14:
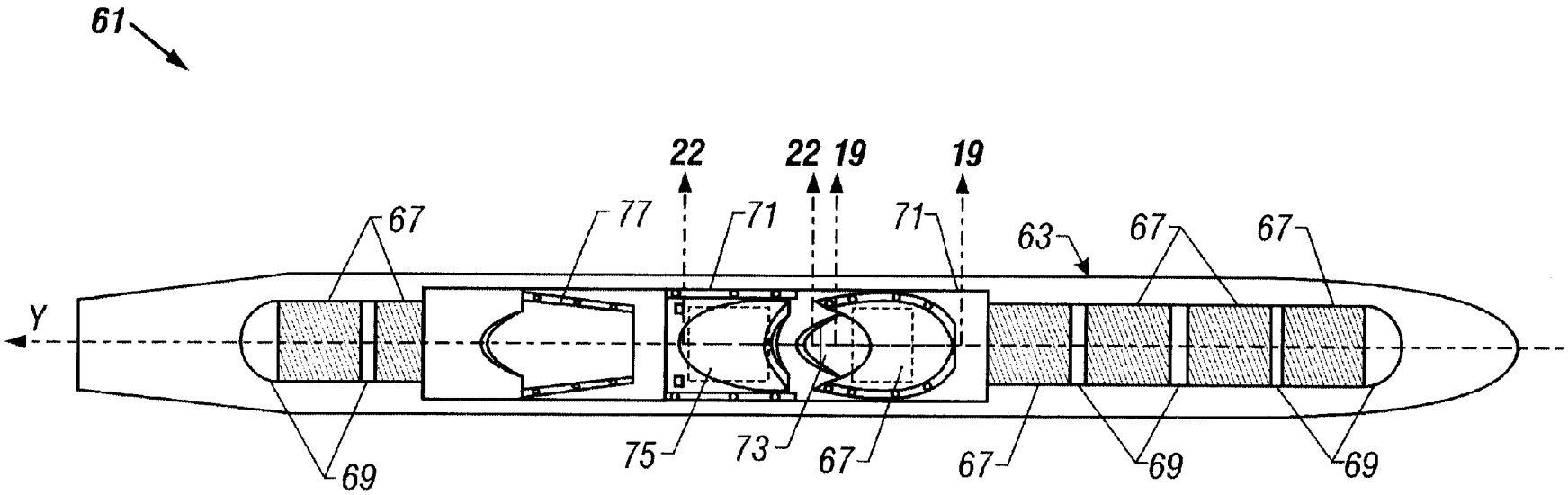
FIG. 14 is a top view of a slalom water ski manufactured according to the teachings of the present invention.

FIG. 14 is a top view of a slalom water ski 61 manufactured according to the teachings of the present invention. The slalom water ski 61 includes a main body 63 having an opening 65 in a central region of the main body 63 and a plurality of enclosed, transverse wing sections 67 mounted to the frame in the central opening 65 along a longitudinal axis Y of the main body 63. Each wing section 67 forms an open slot 69 with an adjacent wing section 67. The slalom water ski 61 also includes a foot binding board 71 supporting a front foot binding 73, a rear foot binding 75, and a slalom binding 77. The slalom water ski 61 may be the same size, shape, and material as those water skis normally used in water skiing.

Figure 15:
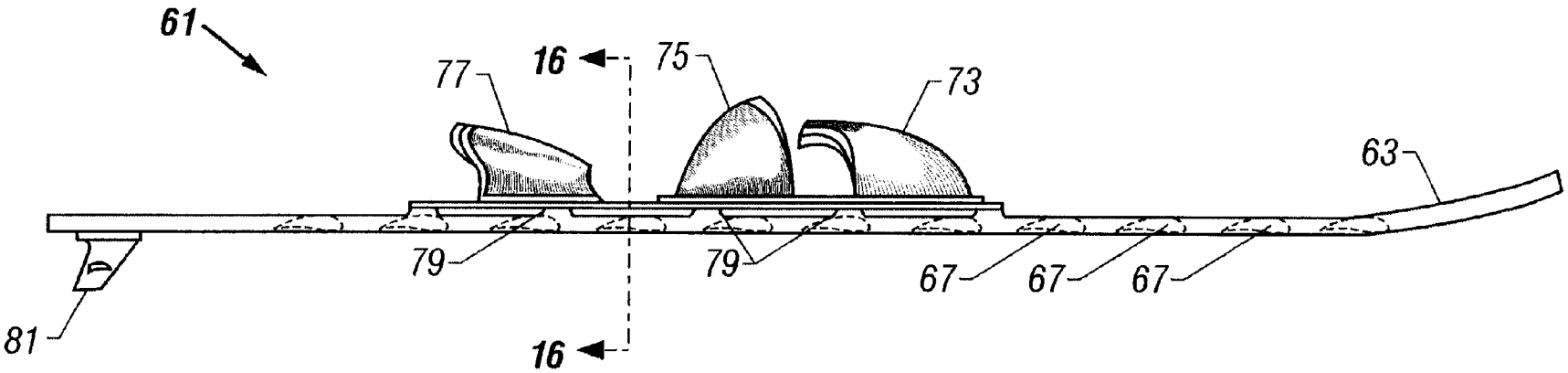
FIG. 15 is a side view of the slalom water ski of FIG. 14 with the enclosed wing sections shown in phantom.

FIG. 15 is a side view of the slalom water ski 61 of FIG. 14 with the enclosed wing sections 67 shown in phantom. The slalom water ski 61 includes a plurality of mounts 79, which are raised platforms located underneath the foot binding board 71. The slalom water ski 61 may also include a slalom fin 81 used for improved maneuvering control by a water skier over the water.

Figure 16:
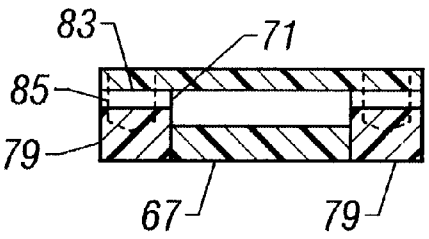
FIG. 16 is a cross-sectional view of the slalom water ski of FIG. 15 taken along line 16—16.

FIG. 16 is a cross-sectional view of the slalom water ski 61 of FIG. 15 taken along line 16—16. The slalom water ski 61 may also include a plurality of screws 83 for attaching the foot binding board 71 to the mount 79. Within the mount 79 is a threaded metal insert 85 through which the screw 83 may be threaded.

Figure 17:
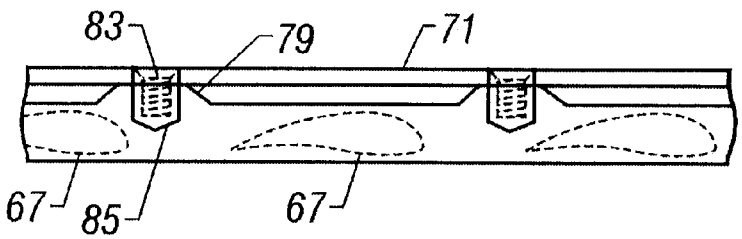
FIG. 17 is an enlarged partial side view of the slalom water ski of FIG. 15 illustrating the foot binding board, screws, and metal inserts with the enclosed wing sections shown in phantom.
Figure 18:
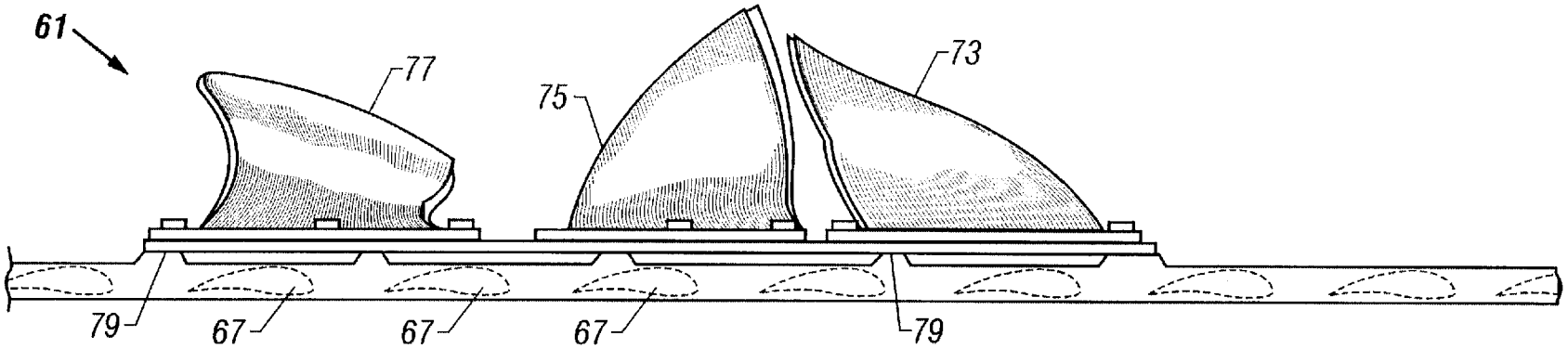
FIG. 18 is an enlarged partial side view of the slalom water ski of FIG. 15 illustrating the foot binding board and foot bindings with the enclosed wing sections shown in phantom.
Figure 19:
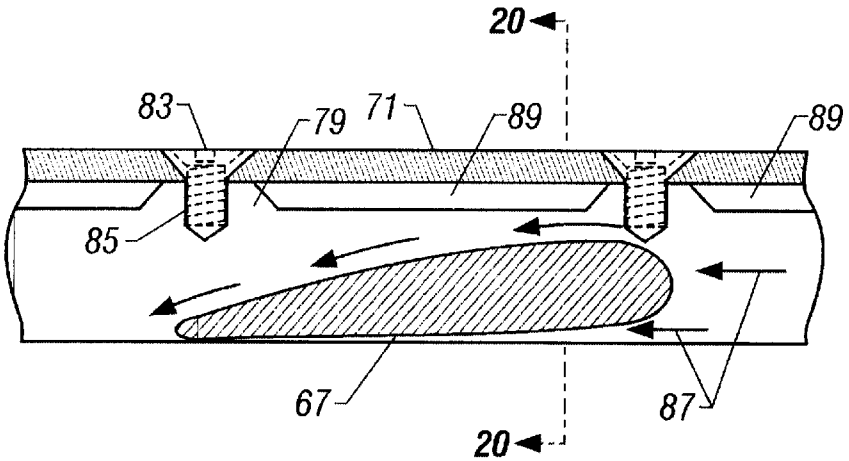
FIG. 19 is a partial cross-sectional view of the slalom water ski of FIG. 14 taken along line 19—19.

FIG. 17 is an enlarged partial side view of the water ski 61 of FIG. 15 illustrating the foot binding board 71, screws 83, and metal inserts 85 with the enclosed wing sections 67 shown in phantom. FIG. 18 is an enlarged partial side view of the water ski of FIG. 15 illustrating the foot binding board 71 and foot bindings with the enclosed wing sections shown in phantom. FIG. 19 is a partial cross-sectional view of the slalom water ski 61 of FIG. 14 taken along line 19—19. The mounts 79 are part of the main body 63 and raise the foot binding board 71 above the main body 63 to allow a fluid flow 87, which could be air or water, to flow around the wing section 67. The mounts 79 allow the fluid flow 87 to enter directly below the foot binding board by providing a series of open spaces 89 in between the mounts 79.

Figure 20:
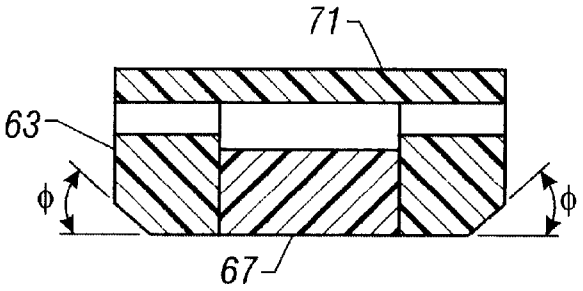
FIG. 20 is a cross-sectional view of the slalom water ski of FIG. 19 taken along line 20—20.

FIG. 20 is a cross-sectional view of the slalom water ski 61 of FIG. 19 taken along line 20—20. A side portion of the main body 63 includes a diagonal cut forming an angle $\phi$ which reduces upward splashing of water resulting when the slalom water ski 61 is skimming a water surface.

Figure 21:
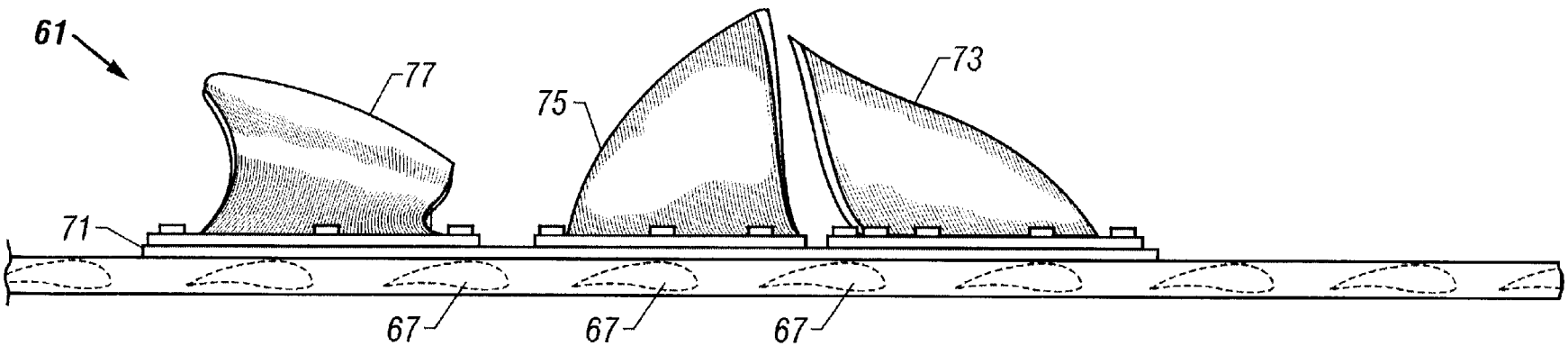
FIG. 21 is an enlarged partial side view of the slalom water ski illustrating the foot binding board in an alternate embodiment of the present invention.
Figure 22:
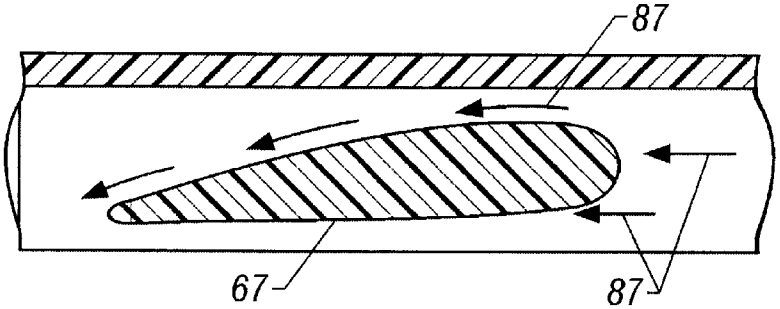
FIG. 22 is a partial cross-sectional view of the slalom water ski of FIG. 14 taken along line 22—22 in an alternate embodiment of the present invention.

FIG. 21 is an enlarged partial side view of the water ski 61 illustrating the foot binding board 71 in an alternate embodiment of the present invention. FIG. 22 is a partial cross-sectional view of the slalom water ski 61 of FIG. 14 taken along line 22—22 in an alternate embodiment of the present invention. FIGS. 21 and 22 illustrate the water ski 31 without the mounts 79. Without the mounts 79, the fluid flow 87 travels at a reduced rate and volume over those wing sections 67 located directly below the foot binding board 71. However, as illustrated in FIG. 22, the fluid flow 87 still circulates at a normal volume and rate around those wing sections 67 not located directly below the foot binding board 71. In addition, FIG. 22 shows that the slalom water ski 61 is constructed of plastic, however any rigid material suitable for skis may be utilized in the construction of the slalom water ski 61, such as carbon fiber with a composite honeycomb core.

In operation, the slalom water ski 61 works in a similar manner to the jumping water ski 31. The air flows through the open slots 69 and over the wing sections 67, thereby providing a lifting force upon the wing sections 67 and overall, on the slalom water ski 61. The skier becomes airborne by jumping a wave or the wake of the boat.

Figure 23:
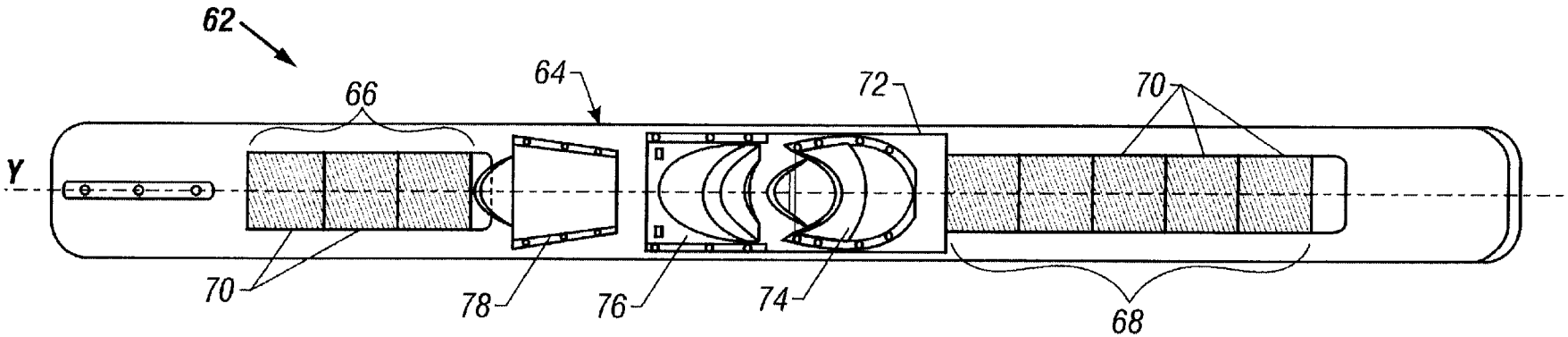
FIG. 23 is a top view of a slalom water ski in an alternate embodiment manufactured according to the teachings of the present invention.

FIG. 23 is a top view of a slalom water ski 62 in an alternate embodiment manufactured according to the teachings of the present invention. The slalom water ski 62 includes a main body 64 having an opening 66 and an opening 68 in a central region of the main body 64 and a plurality of enclosed, transverse wing sections 70 mounted to the fame in each of the openings 66 and 68. Each wing section 70 forms an open slot 82 (see FIG. 24) with an adjacent wing section 70. Unlike the slalom water ski 61, the wing sections 70 overlap one another. The slalom water ski 62 also includes a foot binding support 72 supporting a front foot binding 74, a rear foot binding 76, and a slalom binding 78. The foot binding support 72 is mounted directly to the main body 64. The slalom water ski 61 may be the same size, shape, and material as those water skis normally used in water skiing.

Figure 24:
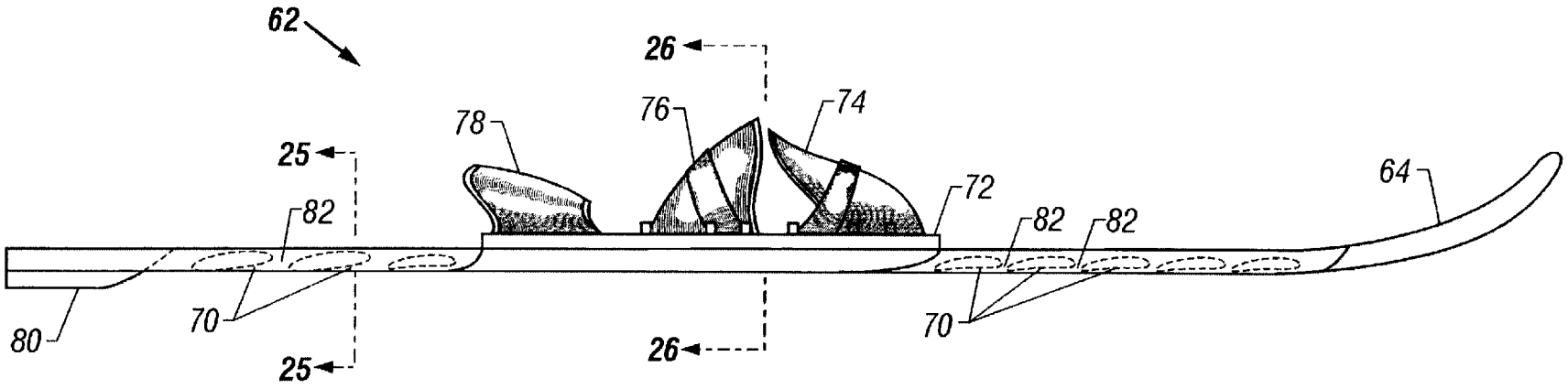
FIG. 24 is a side view of the slalom water ski of FIG. 23 with the enclosed wing sections shown in phantom and the foot binding board mounted directly to the main body.
Figure 26:
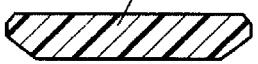
FIG. 26 is a cross-sectional view of the slalom water ski of FIG. 24 taken along line 26—26.
Figure 25:
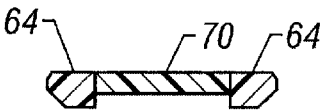
FIG. 25 is a cross-sectional view of the slalom water ski of FIG. 24 taken along line 25—25.

FIG. 24 is a side view of the slalom water ski 62 of FIG. 23 with the enclosed wing sections 70 shown in phantom and the foot binding board 72 mounted directly to the main body 64. Between each wing section 70 is an open slot 82. The slalom water ski 62 may also include a slalom fin 80 used for improved maneuvering control by a water skier over the water. FIG. 25 is a cross-sectional view of the slalom water ski 62 of FIG. 24 taken along line 25—25. FIG. 26 is a cross-sectional view of the slalom water ski 62 of FIG. 24 taken along line 26—26.

The operation of the slalom water ski 62 is similar to the slalom water ski 61. However, by mounting the foot bindings directly to the main body 64 and overlapping the wing sections 70, upward splashing of water is reduced.

Figure 27:
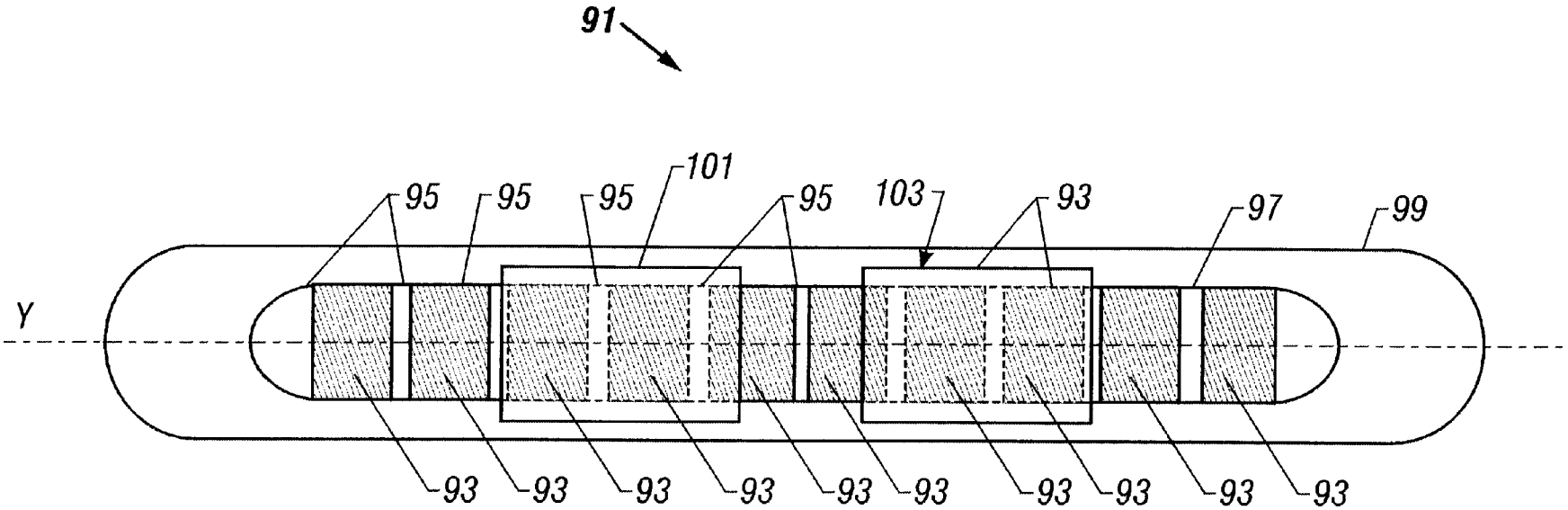
FIG. 27 is a top view diagram of a sky surfboard manufactured according to the teachings of the present invention.

An elongate board may be used in other sports as well. FIG. 27 is a top view diagram of a sky surfboard 91 manufactured according to the teachings of the present invention. The sky surfboard 91 includes a plurality of enclosed, transverse wing sections 93. Each wing section 93 forms an open slot 95 with an adjacent wing section 93 allowing airflow to pass through. The wing sections 93 are located within an opening 97 in a central region of a main body 99. The plurality of wing sections 93 are mounted to the main body 99 in tandem along a longitudinal axis Y of the main body 99. The sky surfboard 91 may also include foot binding boards 101 and 103. The foot binding boards provide a location for securing a sky surfer's feet to the sky surfboard 91, usually through some type of quick release straps or bindings (not shown). The sky surfboard 91 may be the same shape and size as other sky surfboards used in sky surfboarding.

Figure 28:
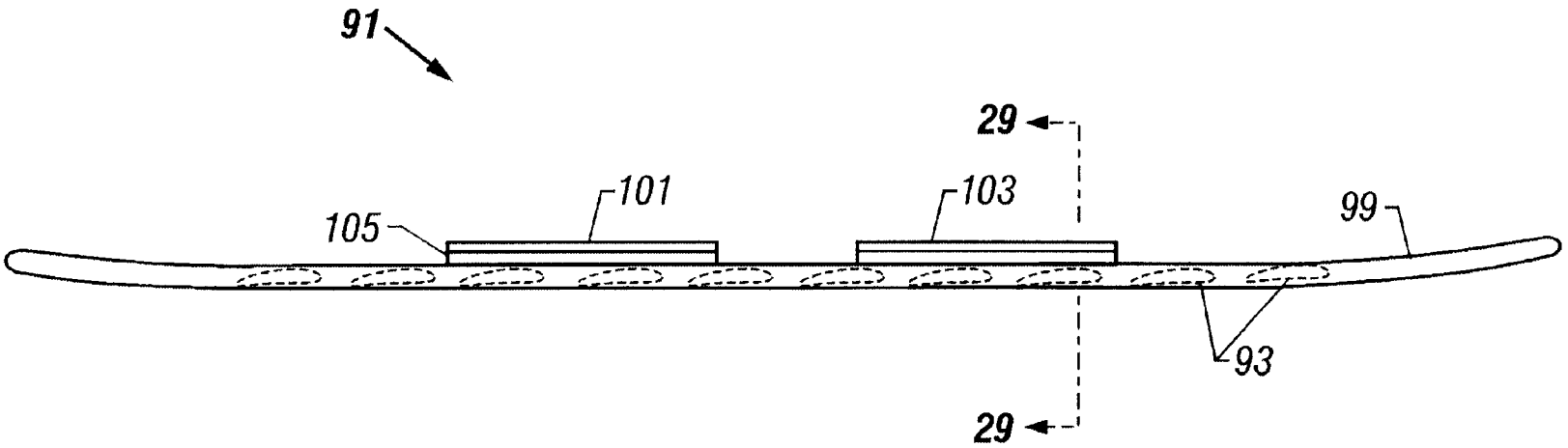
FIG. 28 is a side view of the sky surfboard of FIG. 27 with the enclosed wing sections shown in phantom.

FIG. 28 is a side view of the sky surfboard 91 of FIG. 27 with the enclosed wing sections shown in phantom. The foot binding boards 101 and 103 are supported above the main body 99 by a plurality of mounts 105 for each foot binding board. The mounts are built into the main body 99 and elevate the foot binding boards 101 and 103 to allow air flow to reach the wing sections underneath the foot binding boards 101 and 103, in a similar manner as described above for the jumping water ski 31.

Figure 29:
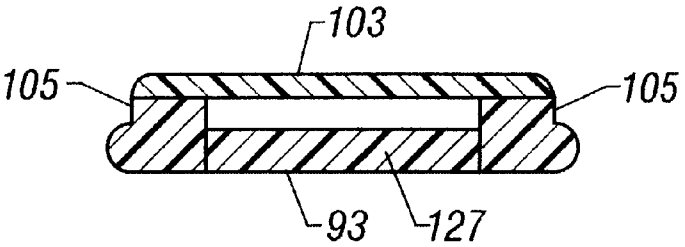
FIG. 29 is a cross-sectional view of the sky surfboard of FIG. 28 taken along line 29—29.

FIG. 29 is a cross-sectional view of the sky surfboard 91 of FIG. 28 taken along line 29—29. Although FIG. 29 illustrates the sky surfboard 91 being constructed of plastic, any rigid material suitable for sky surfboards may be used, such as wood, aluminum, steel, or a composite material.

Figure 30:
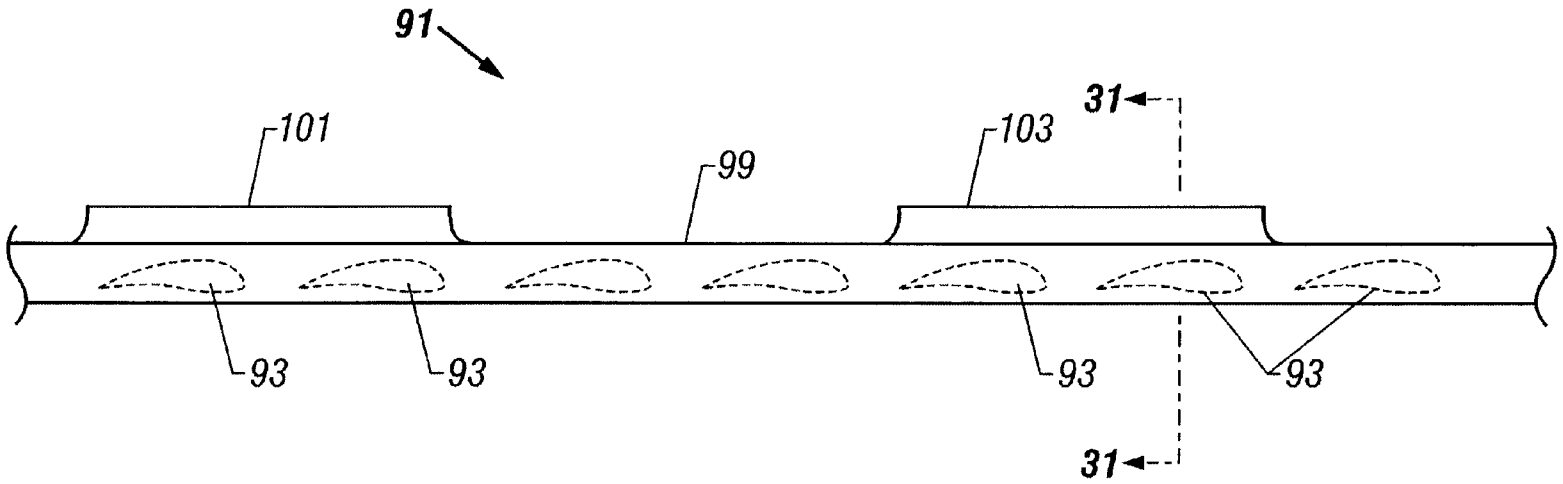
FIG. 30 is an enlarged partial side view of the sky surfboard of FIG. 27 with the enclosed wing sections shown in phantom.
Figure 31:
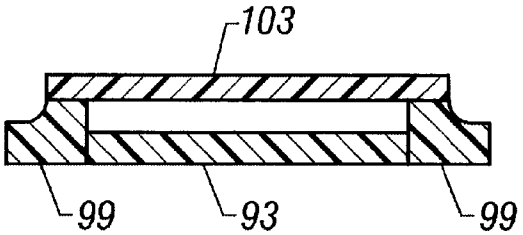
FIG. 31 is an enlarged partial cross-sectional view of the sky surfboard of FIG. 30 taken along line 31—31.

FIG. 30 is an enlarged partial side view of the sky surfboard 91 of FIG. 27 with the enclosed wing sections shown in phantom. FIG. 31 is an enlarged partial cross-sectional view of the sky surfboard of FIG. 30 taken along line 31—31. In FIGS. 30 and 31, the foot binding boards 101 and 103 are mounted directly to the main body 99. In this alternate embodiment, mounts 105 are not utilized to elevate the foot binding boards 101 and 103.

In operation, the sky surfboard 91 works in a similar manner to the jumping water ski 31. The air flows through the open slots 95 and over the wing sections 93, thereby providing a lifting force upon the wing sections 93 and overall, on the sky surfboard 91. The sky surfer mounts his feet upon the foot binding boards 101 and 103. The feet of the surfer are secured to the foot binding boards 101 and 103, usually by a quick-release strapping/binding system (not shown). The sky surfer then jumps out of an airplane, "surfing" while descending to the ground. The wing sections 93 provide a lifting force upon the sky surfboard 91 and the sky surfer, allowing additional free fall time.

Figure 32:
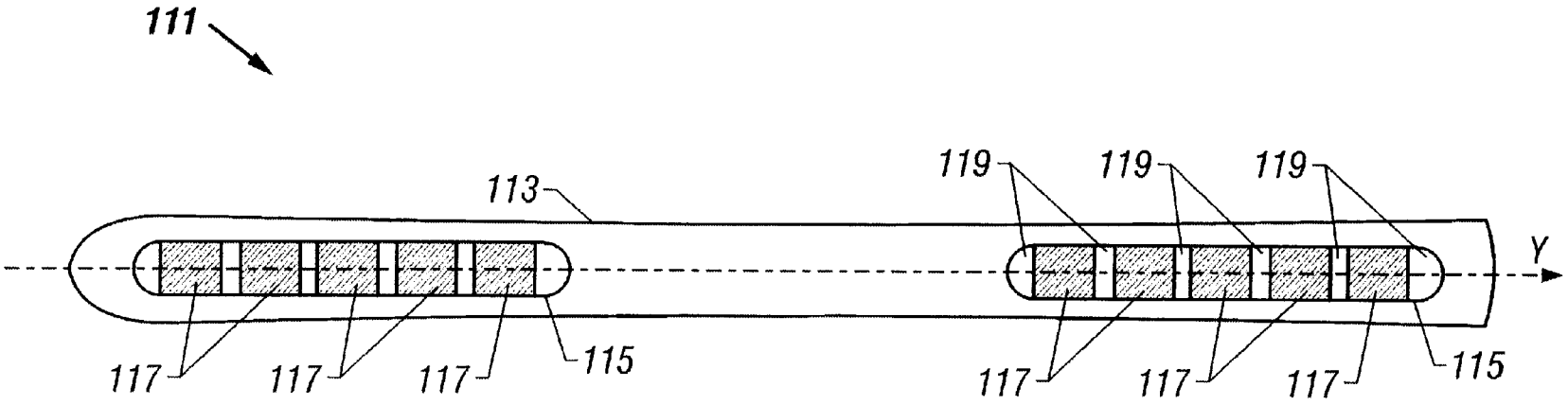
FIG. 32 is a top view of a snow ski manufactured according to the teachings of the present invention.

The elongate board may also be used in snow skiing. FIG. 32 is a top view of a snow ski 111 manufactured according to the teachings of the present invention. The snow ski 111 includes a main body 113 having two openings 115 in a central region of the main body 113. A plurality of enclosed, transverse wing sections 117 are mounted in tandem along a longitudinal axis Y of the main body 113 within each opening 115. Each wing section 117 forms an open slot 119 with an adjacent wing section 117, allowing air and snow to flow over the wing sections 117. Although two openings 115 are illustrated, the snow ski 111 may include one or more openings 115.

Figure 33:
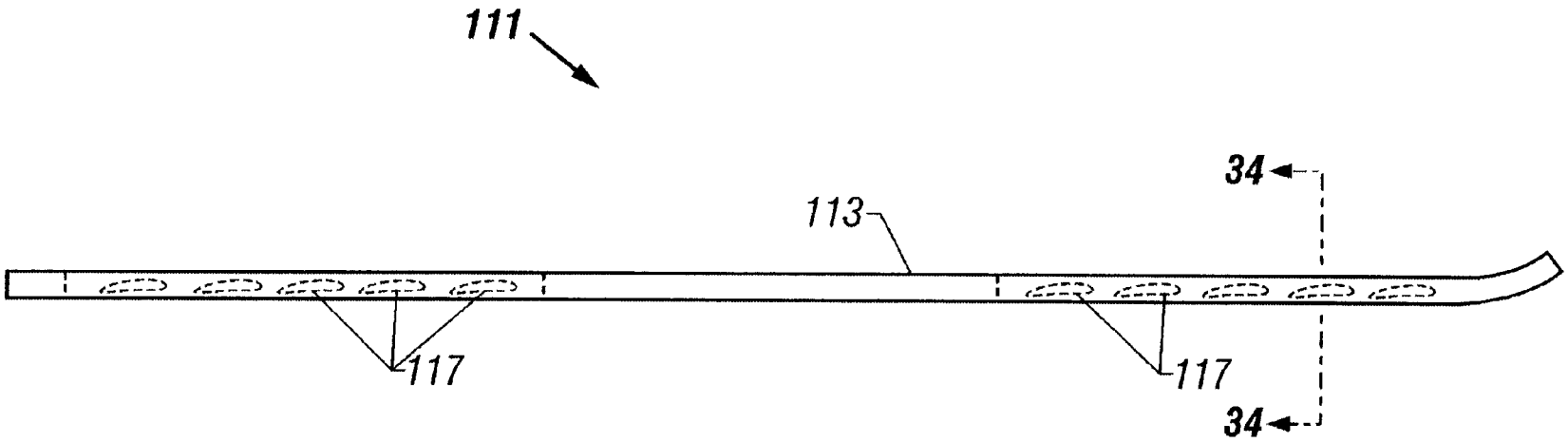
FIG. 33 is a side view of the snow ski of FIG. 32 with the enclosed wing sections shown in phantom.

FIG. 33 is a side view of the snow ski 111 of FIG. 32 with the enclosed wing sections shown in phantom. Although not shown in FIG. 33, in alternate embodiments, the wing sections may run the entire length of the main body 113. Additionally, standard snow boot ski bindings may be utilized to fasten a skier's foot onto the snow ski 111. In alternate embodiments, foot binding boards and mounts integrated into the main body may be utilized in a similar manner as described for the jumping water ski 31 and the sky surfboard 91.

Figure 34:
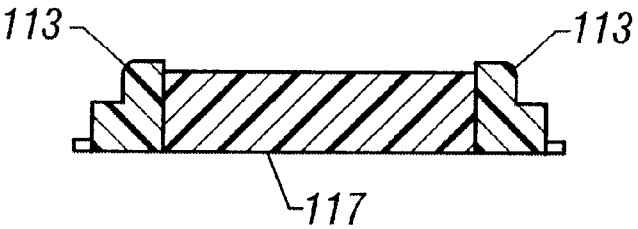
FIG. 34 is an enlarged cross-sectional view of the snow ski of FIG. 33 taken along line 34—34.

FIG. 34 is an enlarged cross-sectional view of the snow ski 111 of FIG. 33 taken along line 34—34. The snow ski 111 may be constructed of plastic, or any other rigid material suitable for snow skis, such as steel, aluminum, wood, or a composite material.

The operation of the snow ski 111 is very similar to the jumping water ski 31. A snow skier skies along the surface of the snow in a normal fashion. In many instances, the skier becomes airborne, such as during a ski jumping event. As the skier becomes airborne, air flows over the wing sections 117, thereby generating lift and increasing the distance traveled while airborne.

Figure 35:
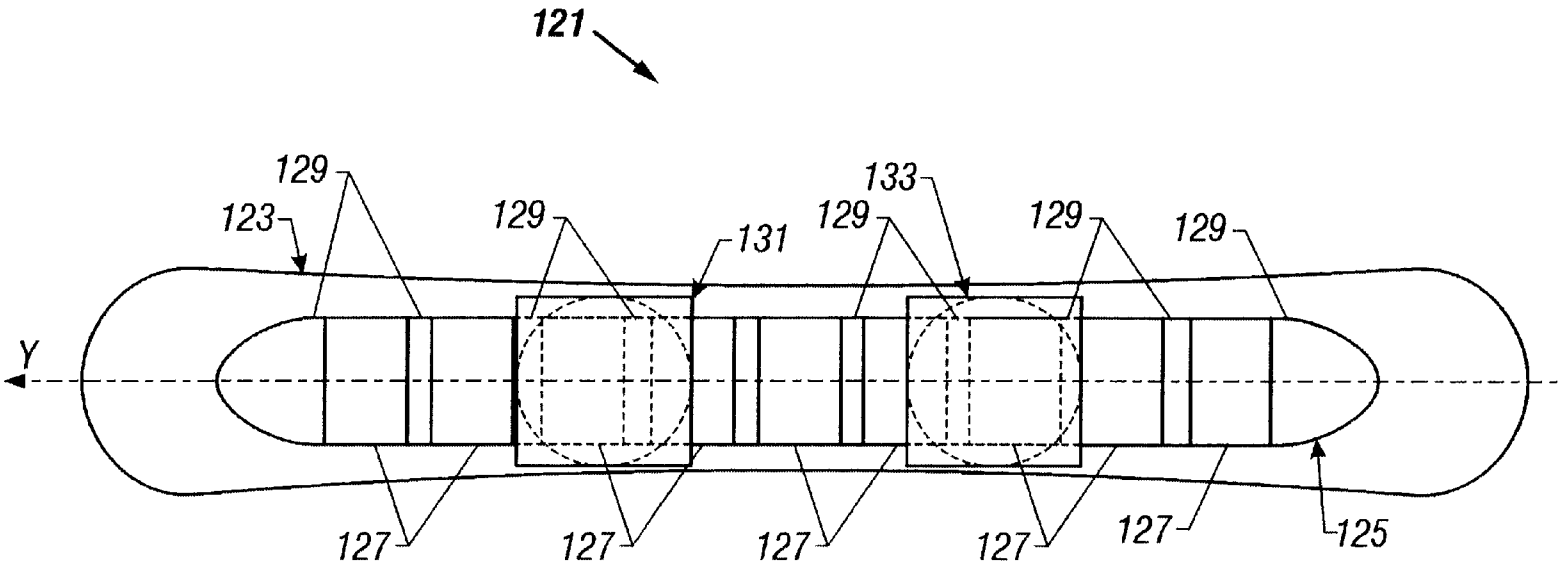
FIG. 35 is a top view of a snow board manufactured according to the teachings of the present invention.

The elongate board may also be used in the sport of snow boarding. FIG. 35 is a top view of a snow board 121 manufactured according to the teachings of the present invention. The snow board 121 includes a main body 123 having an opening 125 located within a central region of the main body 123. The snow board 121 also includes a plurality of enclosed, transverse wing sections 127 mounted to the main body 123 in the opening 125. The plurality of wing sections 127 are arranged in tandem along a longitudinal axis Y of the main body 123. Each wing section 127 forms an open slot 129 with an adjacent wing section 127. The open slots 129 allow air and snow to flow above and below the wing sections 127. The snow board 121 is similar in dimensional size and shape to standard snow boards used in the sport of snow boarding. The snow board 121 also may include foot binding boards 131 and 133. In one embodiment, the foot binding boards 131 and 133 include rotatable binds (not shown), allowing a skier's feet to rotate upon the foot bind boards.

Figure 36:
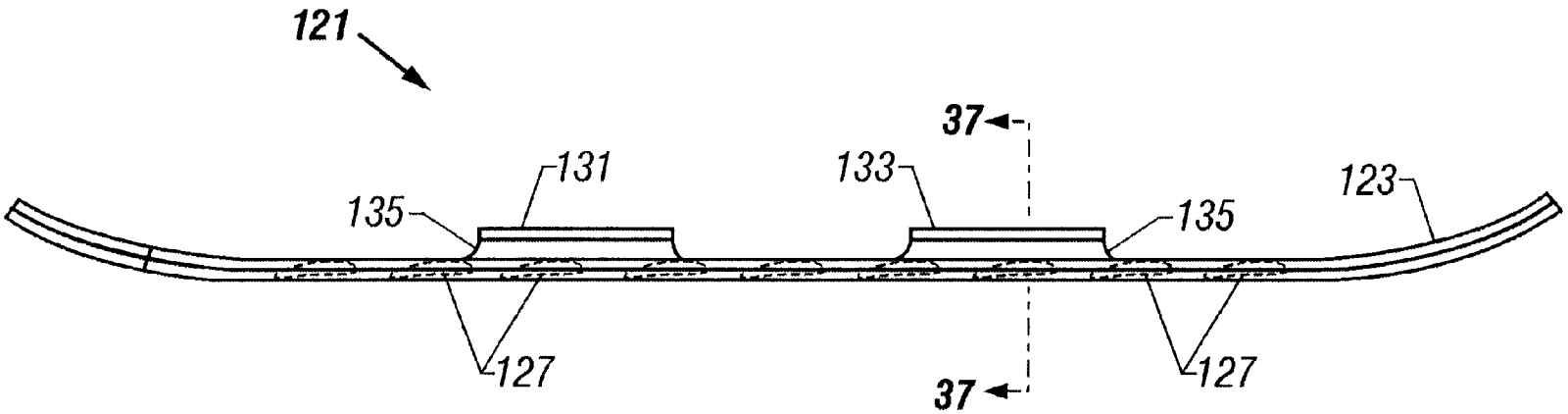
FIG. 36 is a side view diagram of the snow board of FIG. 35 with the enclosed wing sections shown in phantom.

FIG. 36 is a side view diagram of the snow board 121 of FIG. 35 with the enclosed wing sections shown in phantom. The snow board 121 also includes a plurality of mounts 135, integrally attached to the main body 123, to elevate the foot binding boards 131 and 133. Between the mounts 135 is a series of open spaces (not shown) to allow the air to flow through to the wing sections 127. In addition, the elevation of the foot binding boards 131 and 133 allows air and snow to flow at a normal rate and volume through the wing sections 127 directly below the foot binding boards.

Figure 37:
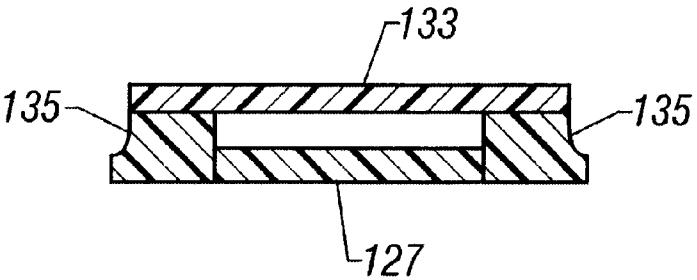
FIG. 37 is an enlarged cross-sectional view of the snow board of FIG. 36 taken along line 37—37.

FIG. 37 is an enlarged cross-sectional view of the snow board 121 of FIG. 36 taken along line 37—37. The mounts 135 elevate the foot binding board 133 above the main body 123 and the wing section 127. Although, FIG. 37 depicts the snow board 121 being constructed of plastic, the snow board 121 may be constructed of any rigid material suitable for snow boards, such as steel, aluminum, wood, or a composite material.

Figure 38:
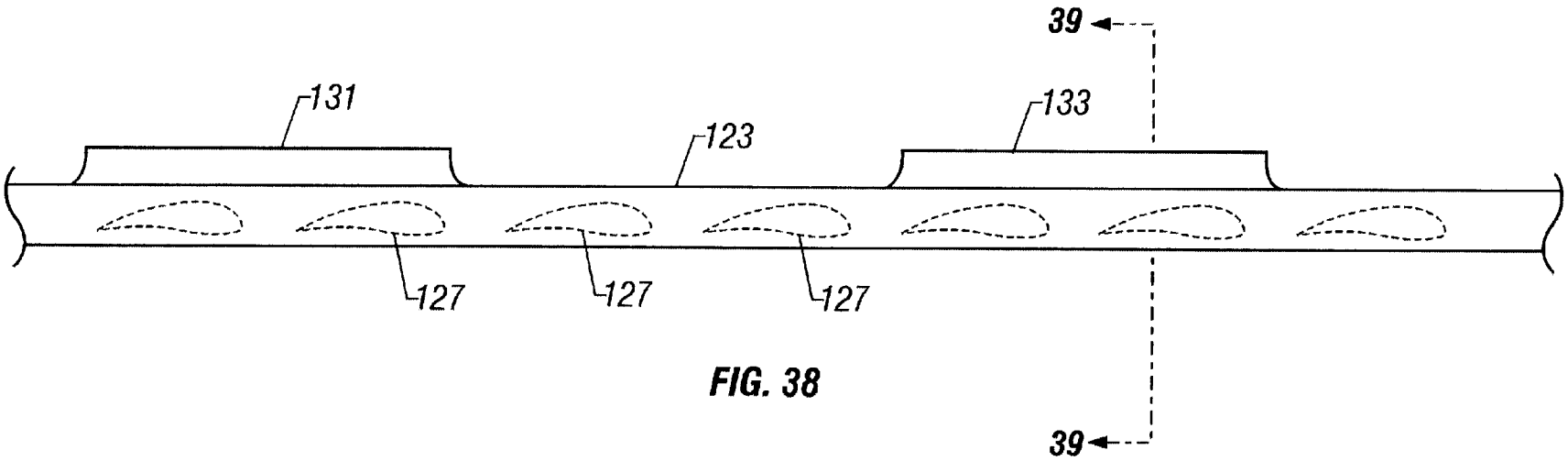
FIG. 38 is a partial side view of the snow board of FIG. 35 illustrating mounting the foot binding boards directly to the main body with the enclosed wing sections shown in phantom.
Figure 39:
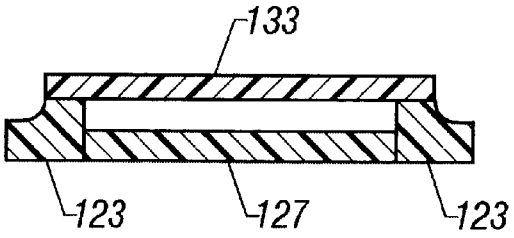
FIG. 39 is a cross-sectional view of the snow board of FIG. 39 taken along line 39—39.

FIG. 38 is a partial side view of the snow board 121 of FIG. 35 illustrating mounting the foot binding boards directly to the main body 123 with the enclosed wing sections shown in phantom. FIG. 39 is a cross-sectional view of the snow board 121 of FIG. 38 taken along line 39—39. In the alternate embodiment illustrated in FIGS. 38 and 39, the foot binding boards 131 and 133 are mounted flush to the main body 123.

The operation of the snow board 121 is similar to all the previously described embodiments of the elongate board. The wing sections 127 provide a lifting force for the snow board 121 when airborne. This enables the snow boarder to remain airborne longer, providing superior performance, and giving moving time to complete airborne maneuvers.

The elongate board may be used in other sports that require a use of a ski or board and where increased lifting performance is desired. The elongate board provides many advantages over current skis and boards. First, it produces an increased lifting force which is desired by many skiers when executing various airborne maneuvers. Additionally, the elongate board does not reduce other performance capabilities available in conventional skis since the elongate board may incorporate all of the size, shape, and materials used in current conventional skis or boards. The elongate board is also simple in design and lighter than conventional skis or boards.

It is thus believed that the operation and construction of the present invention will be apparent from the foregoing description. While the apparatus shown and described has been characterized as being preferred, it will be readily apparent that various changes and modifications could be made therein without departing from the spirit and scope of the invention as defined in the following claims.

What is claimed is:

1. An elongate board which produces increased lift when moved through a fluid, comprising:

a main body frame having an opening in a central region thereof, and a plurality of enclosed, transverse wing sections mounted to the frame in the central opening in tandem along a longitudinal axis of the main body frame, each wing section of the plurality of wing sections forming an open slot with an adjacent wing section through which the fluid may flow, whereby the flow of the fluid over the wing sections creates a lifting force upon the elongate board.

2. The elongate board of claim 1 wherein the main body frame is shaped as a snow ski.

3. The elongate board of claim 2 further comprising:

a platform located on a top surface of the main body frame; and a foot binding apparatus for binding a foot of a skier to the platform.

4. The elongate board of claim 3 further comprising a plurality of mounts for elevating the platform above the top surface of the main body frame, the plurality of mounts integrally connected to the main body frame, thereby allowing the fluid to flow above and below each wing section located below the platform.

5. The elongate board of claim 1 wherein the main body frame is shaped as a water ski.

6. The elongate board of claim 5 further comprising:

a platform located on top of a top surface of the main body frame; and a first binding apparatus for securing a first foot of a skier onto the platform.

7. The elongate board of claim 6 further comprising a plurality of mounts for elevating the platform above the top surface of the main body frame, the plurality of mounts integrally connected to the main body frame, thereby allowing the fluid to flow above and below each wing section located below the platform.

8. The elongate board of claim 6 further comprising a second binding apparatus for securing a second foot of the skier onto the platform.

9. The elongate board of claim 1 wherein the main body frame is shaped as a snow board.

10. The elongate board of claim 9 further comprising:

a first platform located on top of a top surface of the main body frame; and a first binding apparatus for securing a first foot of a skier onto the first platform.

11. The elongate board of claim 10 further comprising a first plurality of mounts for elevating the first platform above the top surface of the main body frame, the mounts integrally connected to the main body frame, thereby allowing the fluid to flow above and below each wing section located below the first platform.

12. The elongate board of claim 9 further comprising:

a second platform located on top of a top surface of the main body frame; and a second binding apparatus for securing a second foot of a skier onto the second platform.

13. The elongate board of claim 12 further comprising a second plurality of mounts for elevating the second platform above the top surface of the main body frame, the mounts integrally connected to the main body frame, thereby allowing the fluid to flow above and below each wing section located below the second platform.

14. The elongate board of claim 13 wherein:

the first binding apparatus includes means for rotating the first foot of a skier upon the first platform; and the second binding apparatus includes means for rotating the second foot of a skier upon the second platform.

15. The elongate board of claim 1 wherein the main body frame is shaped as a sky surfboard.

16. The elongate board of claim 15 further comprising:

a first platform located on top of a top surface of the main body frame; and a first binding apparatus for securing a first foot of a skier onto the first platform.

17. The elongate board of claim 16 further comprising a first plurality of mounts for elevating the first platform above the top surface of the main body frame, the mounts integrally connected to the main body frame, thereby allowing the fluid to flow above and below each wing section located below the first platform.

18. The elongate board of claim 17 further comprising:

a second platform located on top of a top surface of the main body frame; and a second binding apparatus for securing a second foot of a skier onto the second platform.

19. The elongate board of claim 18 further comprising a second plurality of mounts for elevating the second platform above the top surface of the main body frame, the mounts integrally connected to the main body frame, thereby allowing the fluid to flow above and below each wing section located below the second platform.

20. The elongate board of claim 1 further comprising a foot binding apparatus for binding a foot of a user located on a top surface of the main body frame.

21. An elongate board which produces increased lift, comprising:

a main body frame having a plurality of openings in a central region thereof; and a plurality of enclosed, transverse wing sections mounted to the frame in the plurality of openings in tandem along a longitudinal axis of the main body frame, each wing section of the plurality of wing sections forming an open slot with an adjacent wing section through which a fluid may flow, whereby the flow of the fluid over the wing sections creates a lifting force upon the elongate board.

22. The elongate board of claim 17 further comprising:

a platform located on a top surface of the main body frame; and a foot binding apparatus for binding a foot of a skier to the platform.

23. The elongate board of claim 18 further comprising a plurality of mounts for elevating the platform above the top surface of the main body frame, the plurality of mounts integrally connected to the main body frame, thereby allowing the fluid to flow over each wing section located below the platform.

24. The elongate board of claim 18 wherein each wing section of the plurality of wing sections overlaps an adjacent wing section.

* * * * *